US007571827B2

(12) United States Patent
Haley et al.

(10) Patent No.: US 7,571,827 B2
(45) Date of Patent: Aug. 11, 2009

(54) RETORT CONTAINER

(75) Inventors: Tim Haley, Chicago, IL (US); Justin Howell, New Cumberland, PA (US); Ed Roubal, Stewartstown, PA (US)

(73) Assignee: Graham Packaging Company, L.P., York, PA (US)

( * ) Notice: Subject to any disclaimer, the term of this patent is extended or adjusted under 35 U.S.C. 154(b) by 645 days.

(21) Appl. No.: 11/141,322

(22) Filed: Jun. 1, 2005

(65) Prior Publication Data

US 2006/0273064 A1 Dec. 7, 2006

(51) Int. Cl.
*B65D 1/40* (2006.01)
*B65D 1/02* (2006.01)

(52) U.S. Cl. ..... 215/381; 215/379; 220/666; 220/669; 220/675

(58) Field of Classification Search ..... 215/379, 215/381–383; 220/666, 669, 675
See application file for complete search history.

(56) References Cited

U.S. PATENT DOCUMENTS 5,269,437 A * 12/1993 Gygax ..... 220/606
5,750,226 A * 5/1998 Macauley et al. ..... 428/36.4
6,612,451 B2 * 9/2003 Tobias et al. ..... 215/375
6,763,968 B1 * 7/2004 Boyd et al. ..... 220/608
6,997,336 B2 * 2/2006 Yourist et al. ..... 215/379
2001/0035392 A1 * 11/2001 Ota et al. ..... 215/381
2002/0008077 A1 * 1/2002 Lane et al. ..... 215/381
2003/0000911 A1 * 1/2003 kelley et al. ..... 215/381
2003/0221987 A1 * 12/2003 Trude ..... 206/508
2004/0159627 A1 8/2004 Trude
2004/0159628 A1 * 8/2004 Trude ..... 215/382
2006/0175284 A1 * 8/2006 Noll et al. ..... 215/382

FOREIGN PATENT DOCUMENTS

WO WO 00/58175 10/2000
WO WO 03/080460 10/2003

* cited by examiner

*Primary Examiner*—Sue A Weaver
(74) *Attorney, Agent, or Firm*—Knoble Yoshida & Dunleavy, LLC

(57) ABSTRACT

A plastic container for use in a sterilization process includes a neck having a finish, an upper transition portion extending from the neck, a generally polygonal structure having a plurality of relatively flat panels separated by columns, and a base portion where the generally polygonal structure is disposed between the upper transition portion and the base portion. Adjacent relatively flat panels together with the separating column form an angle so that the relatively flat panels of the generally polygonal structure move together after the sterilization process thereby maintaining the aesthetics of the plastic container.

20 Claims, 10 Drawing Sheets

RETORT CONTAINER

BACKGROUND OF THE INVENTION

1. Field of the Invention

The present invention relates generally to a plastic container, and more particularly to a wide mouth plastic container that can withstand the retort sterilization process.

2. Related Art

Plastic blow-molded containers, particularly those molded of PET, have been utilized in hot fill applications where the container is filled with a liquid product heated to a temperature in excess of 180° F. (82° C.), capped immediately after filling, and allowed to cool to ambient temperatures. Plastic blow-molded containers have also been utilized in pasteurization and retort processes, where a filled and sealed container is subjected to thermal processing and is then cooled to ambient temperatures. Pasteurization and retort methods are frequently used for sterilizing solid or semi-solid food products, e.g., pickles and sauerkraut. The products may be packed into the container along with a liquid at a temperature less than 82° C. (180° F.) and then sealed and capped, or the product may be placed in the container that is then filled with liquid, which may have been previously heated, and the entire contents of the sealed and capped container are subsequently heated to a higher temperature. As used herein, "high-temperature" pasteurization and retort are sterilization processes in which the product is exposed to temperatures greater than about 80° C.

Pasteurization and retort differ from hot-fill processing by including heating the filled container to a specified temperature, typically greater than 93° C. (200° F.), until the contents of the filled container reach a specified temperature, for example 80° C. (175° F.), for a predetermined length of time. That is, the external temperature of the hot-filled container may be greater than 93° C. so that the internal temperature of a solid or semi-solid product reaches approximately 80° C. Retort processes also involve applying overpressure to the container.

Plastic containers have replaced or provided an alternative to glass containers for many applications. However, few food products that must be processed using pasteurization or retort are available in plastic containers. The rigors of such processing present significant challenges for the use of plastic containers, including containers designed for use in hot-fill processing. For example, during a retort process, when a plastic container is subjected to relatively high temperatures and pressures, the plastic container's shape will distort. Upon cooling, the plastic container generally retains this distorted shape or at least fails to return to its pre-retort shape. Accordingly, there remains a need to provide plastic containers that can withstand the rigors of pasteurization and retort processing in order to take advantage of the cost savings that can be realized through manufacture and recycling. The lighter weight of plastic containers as compared to glass can also advantageously reduce shipping costs.

BRIEF SUMMARY OF THE INVENTION

Accordingly, this invention provides for a plastic container for use in a sterilization process that allows the plastic container to maintain its aesthetic shape during subsequent pressures (e.g., 35 to 175 kPa) encountered during high-temperature pasteurization or retort of the contents within the plastic container, and during subsequent cooling, shipment, and use of the plastic container.

This is achieved by a plastic container that includes a neck having a finish, an upper transition portion extending from the neck, a generally polygonal structure having a plurality of relatively flat panels separated by columns, and a base portion where the generally polygonal structure is disposed between the upper transition portion and the base portion. Adjacent relatively flat panels together with the separating column form an angle so that the relatively flat panels of the generally polygonal structure move together after the sterilization process thereby maintaining the aesthetics of the plastic container. In a preferred embodiment, the neck of the plastic container may include a wide mouth. However, the structure of the invention should work whether the neck has a standard mouth with a finish or a wide mouth finish.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Figure 1:
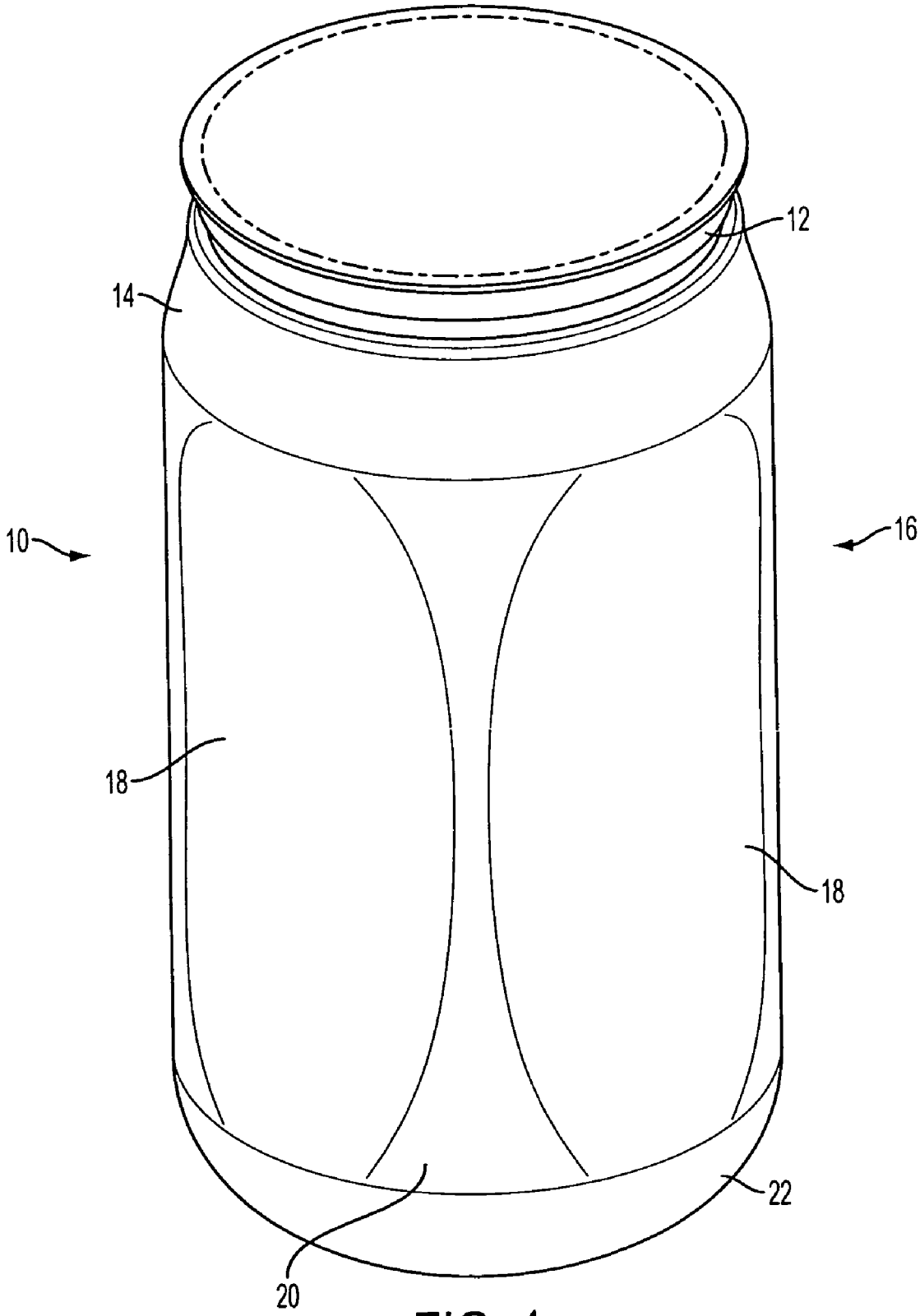
FIG. 1 depicts an exemplary embodiment of a wide mouth plastic container according to the present invention.
Figure 2:
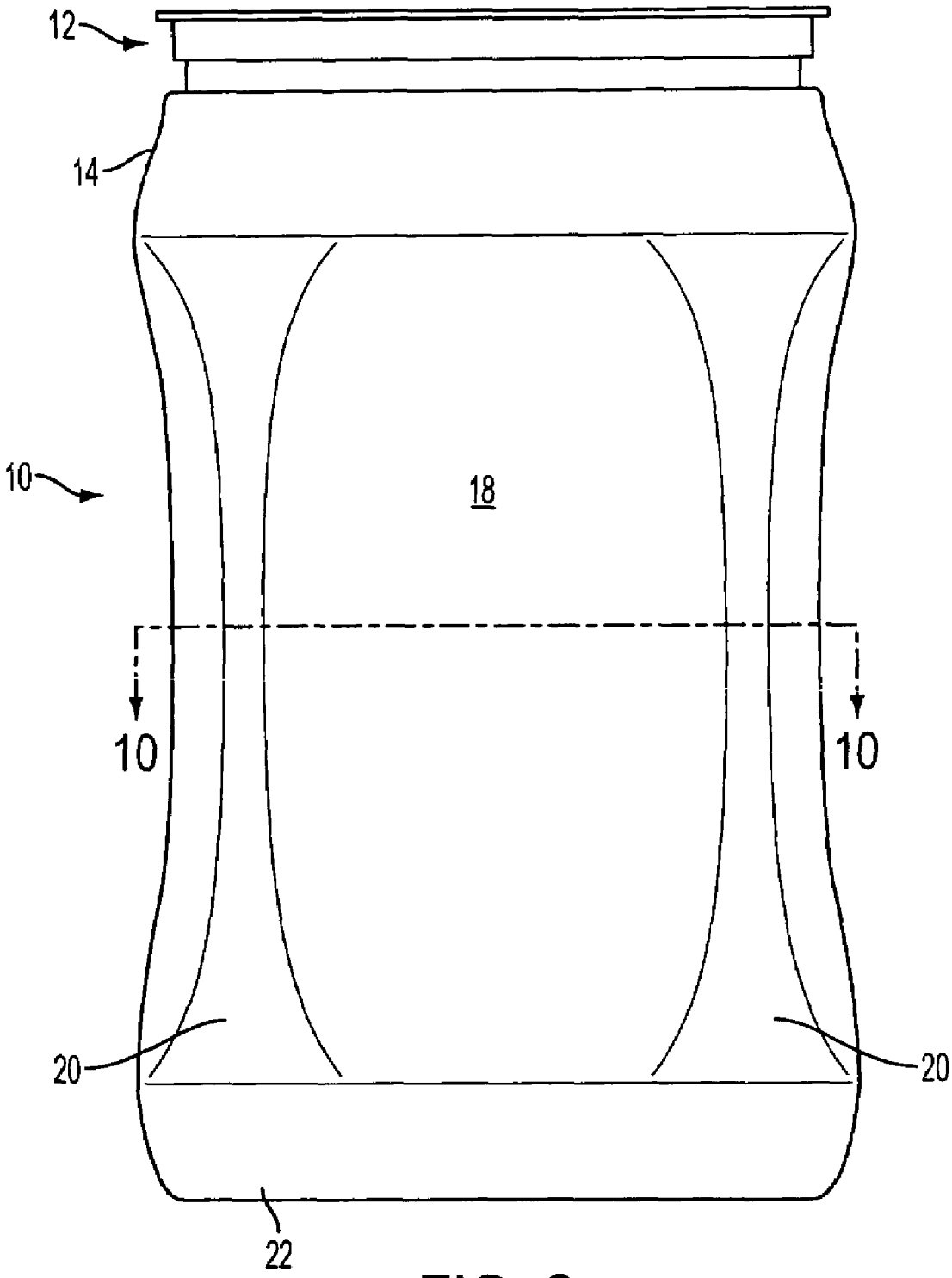
FIG. 2 is a front view of the exemplary embodiment shown in FIG. 1.

Looking at FIG. 1, a wide mouth container 10 according to an exemplary embodiment of the invention includes a wide mouth neck 12 with a finish, an upper transition portion 14 extending from wide mouth neck 12, a generally polygonal structure 16 having a plurality of relatively flat panels 18 separated by columns 20, and a base portion 22. As described below, the term "relatively flat" includes slight curvatures. Generally polygonal structure 16 is disposed between upper transition portion 14 and base portion 22. The curvature of the relatively flat panels 18 and/or the angle at which adjacent relatively flat panels 18 meet at respective columns or corners 20 allow container 10 to withstand the pressures associated with retort or other sterilization process.

Figure 8:
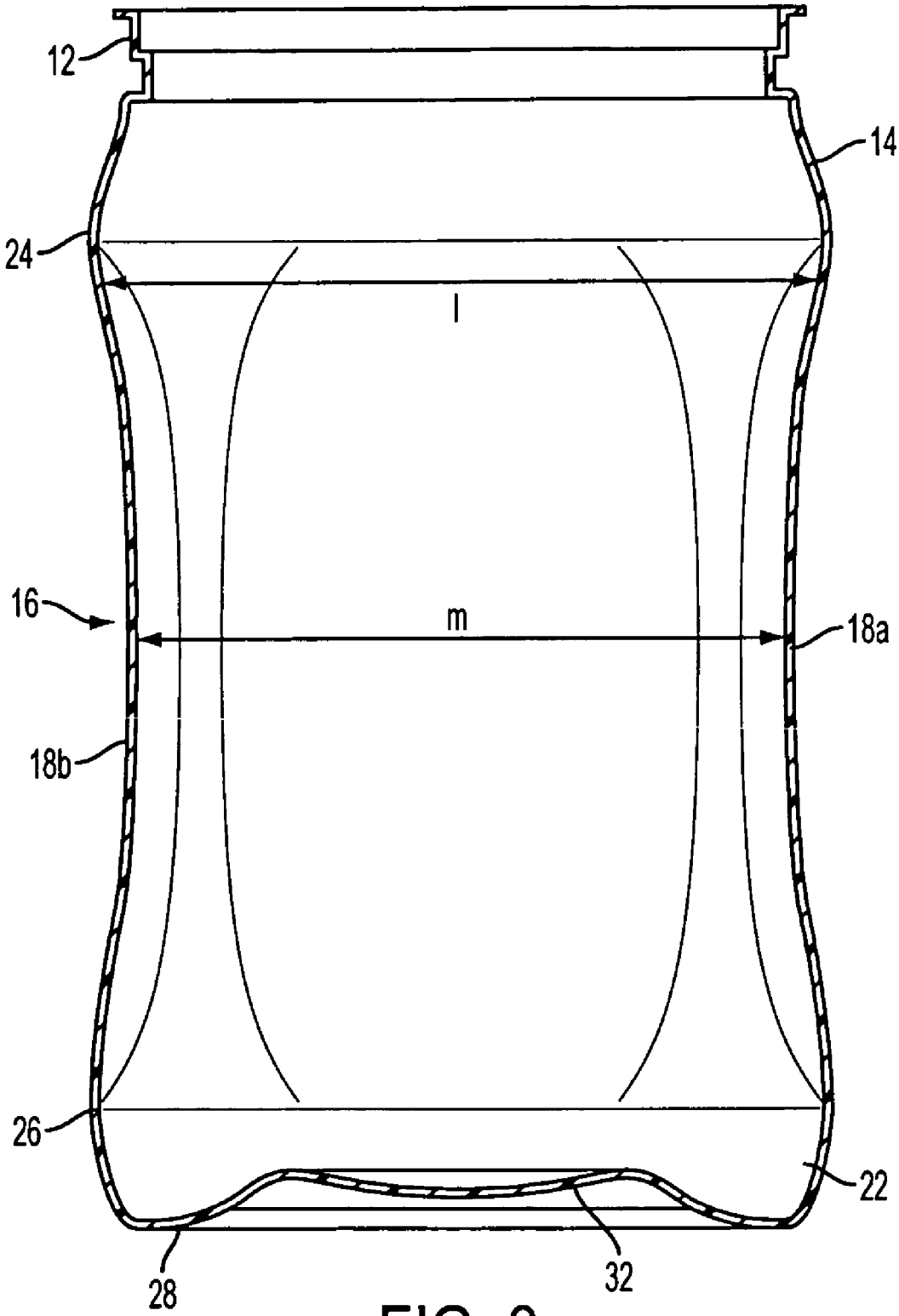
FIG. 8 is a cross-sectional view taken along line 8-8 of the exemplary embodiment shown in FIG. 4.

Wide mouth container 10 may have an upper transition portion that is rounded or approximately circular in cross-section. Likewise, base portion 22 may be rounded or approximately circular in cross-section. Thus, container 10 may have an approximate round cross-section which transitions into an approximately polygonal cross-section that transitions into an approximate round cross-section. As shown in FIG. 8, upper transition portion 14 extends outwardly from neck 12 until it transitions into generally polygonal structure 16 at upper area 24. Similarly, generally polygonal structure 16 transitions into base portion 22 at lower area 26. The diameter of base section 22 slowly decreases until the actual base surface 28 is reached. The generally polygonal structure 16 of wide mouth container 10 serves to take up the vacuum that results from subsequent cooling of a hot-filled product, and also compensates for the pressure difference due to the sterilization process and any subsequent cooling so that container 10 will not collapse inwardly resulting in an unaesthetic container for a product.

The angle θ at which adjacent relatively flat panels 18 meet at respective columns or corners 20 enables the sides of the polygonal structure 16 to move more readily than the rounded upper transition 14 and base portion. The angle θ formed at column or corner 20 may be between about 60° to about 160°, The angle θ serves as a hinge so that relatively flat panels 18 can move together to compensate for the overpressure associated with the retort sterilization process and to absorb the resultant vacuum produced by the cooling of the sterilized, hot-filled product. As the corner between relatively flat panels 18 becomes sharper, a hinge is created so that relatively flat panels 18 can move inward or outwardly depending upon the pressure or vacuum to which the container is subjected. That is, the polygonal structure is designed so that at least one relatively flat panel serves as a "vacuum panel". Generally, all of the relatively flat panels 18 may move together at the "hinge" points to compensate for overpressure or the resultant vacuum.

In a preferred embodiment of the invention, the polygonal structure is generally square shaped in cross-section. The angle θ formed by column 20 and adjacent relatively flat panels 18 is such that the corners 20 may have an approximate radius, but the angle is sharp enough to provide the desired hinge effect without creating a container that is objectionable ergonomically. For example, if columns or corner 20 are too sharp, a consumer may object to the container. On the other hand, if the approximate radius is too large, the container may lose the desired hinge effect. Consequently, the plastic container 10 would loose its ability to withstand the pressure differences associate with overpressure and to compensate for vacuum while maintaining the aesthetic look of the container. That is, the relatively flat panels may collapse upon themselves if the angle θ is too large or too small. Columns 20 should be rounded on the outside to create a more appealing feel and look for the product. In this embodiment, all four sides should move together thereby creating an aesthetic container that can withstand the retort process and vacuum resulting from the subsequent cooling. The angle θ between relatively flat panels 18 may depend upon the size of the container and/or the density of the material making the container. A label panel may be wrapped about the generally polygonal structure 16.

Figure 3:
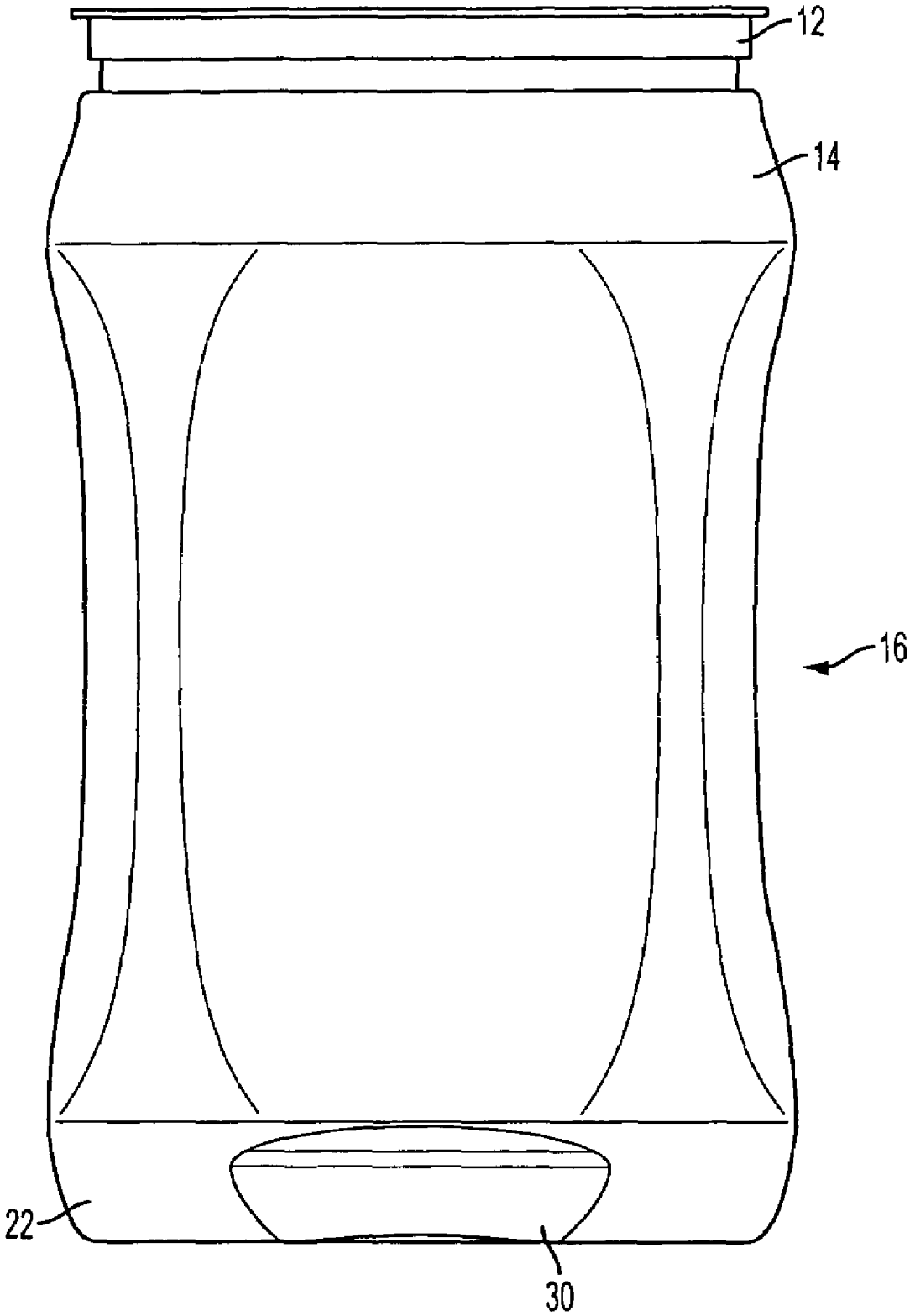
FIG. 3 is a rear view of the exemplary embodiment shown in FIG. 1.
Figure 4:
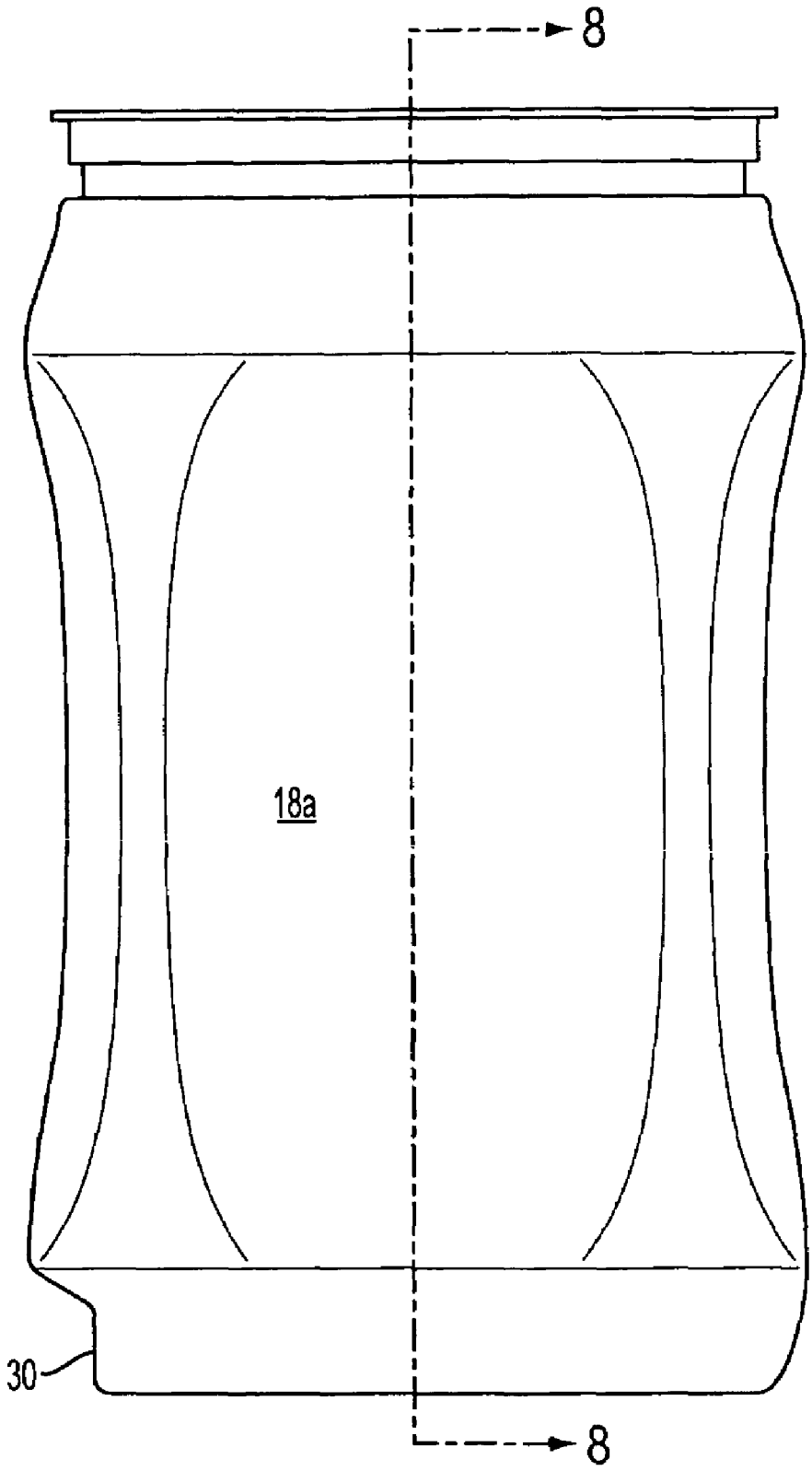
FIG. 4 is a left side view of the exemplary embodiment shown in FIG. 1.
Figure 5:
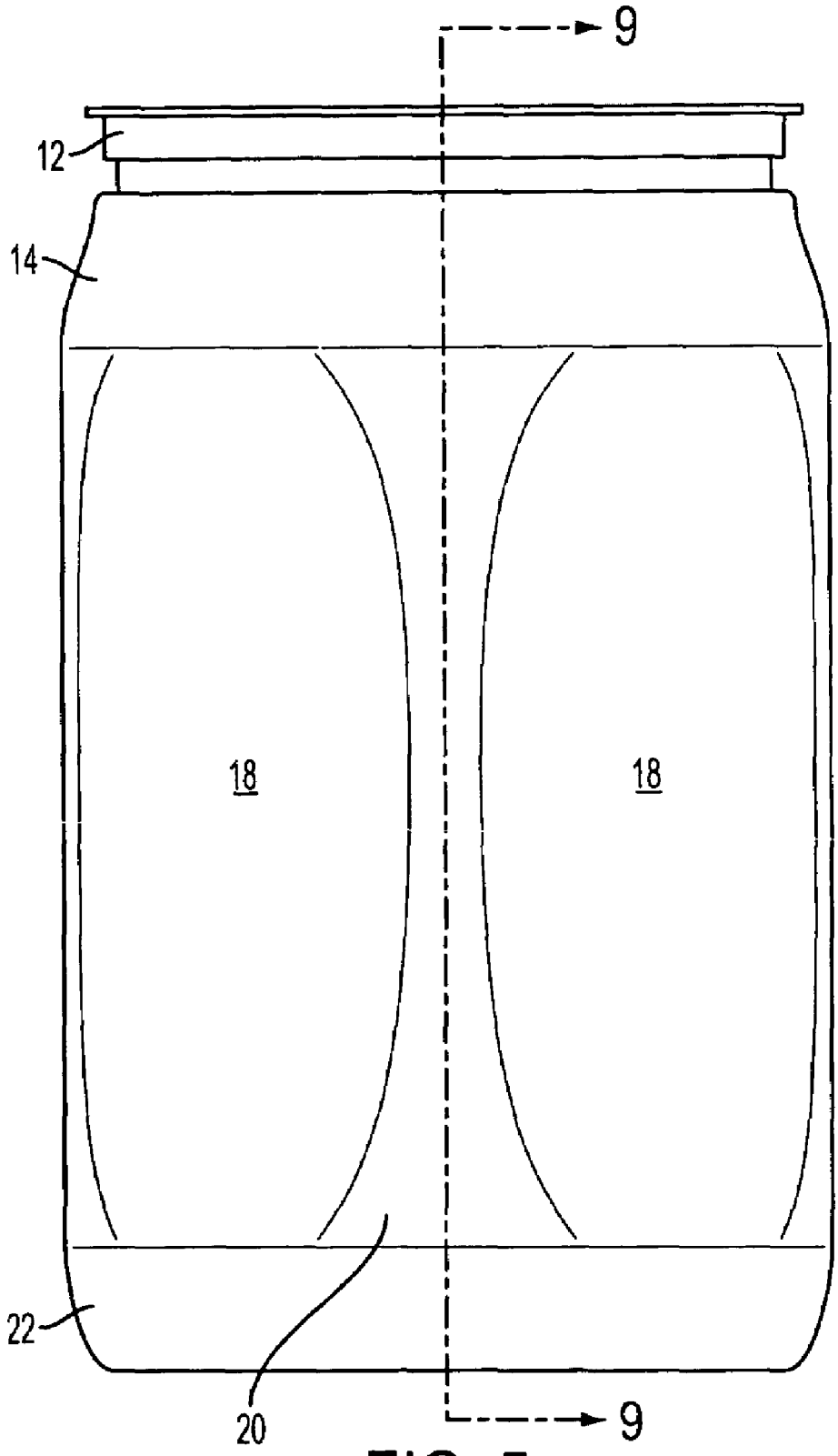
FIG. 5 is a view of an exemplary container according to the present invention showing a corner of the wide mouth container at an angle of approximately 45° from the side view of FIG. 4.
Figure 6:
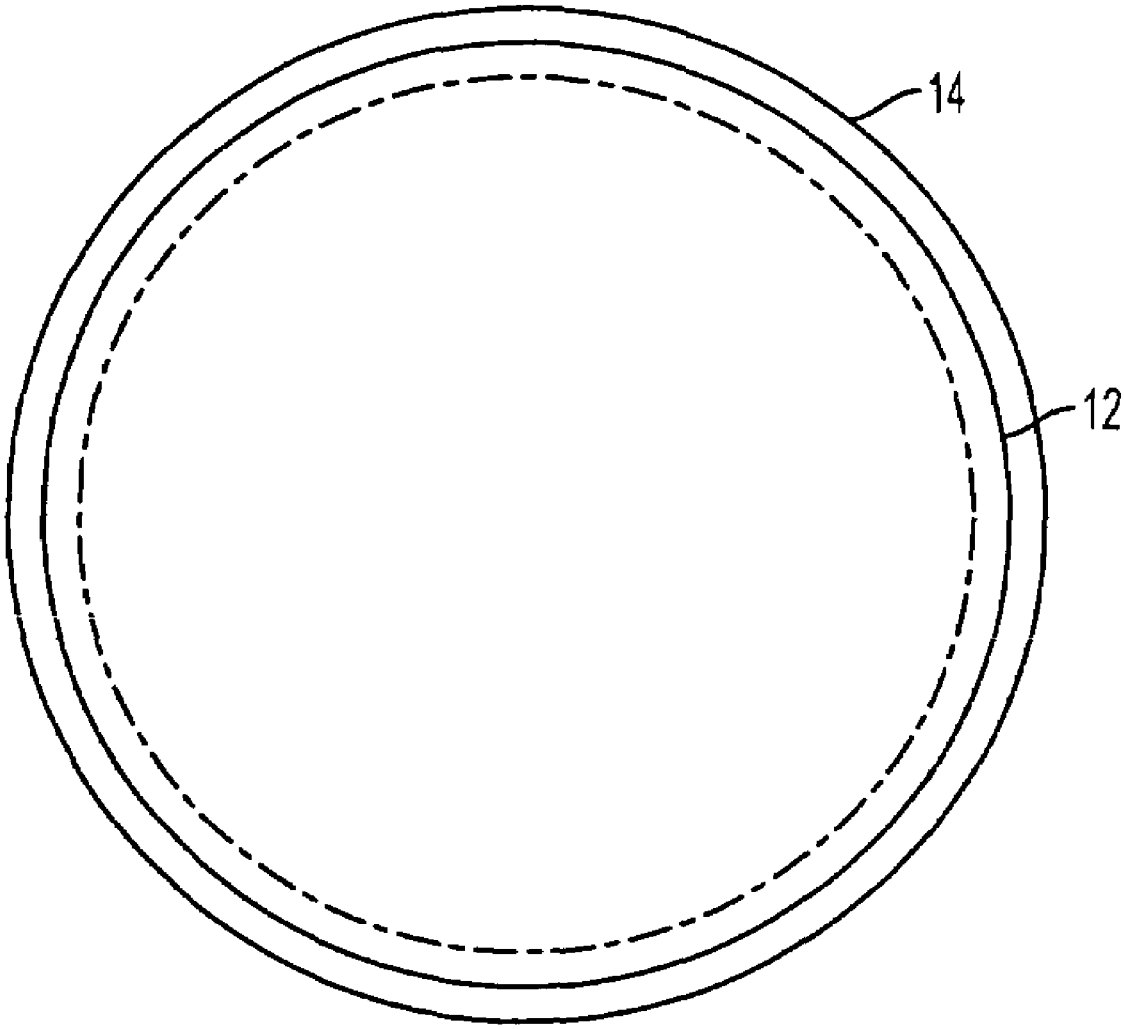
FIG. 6 is a top view of the exemplary embodiment shown in FIG. 1.
Figure 7:
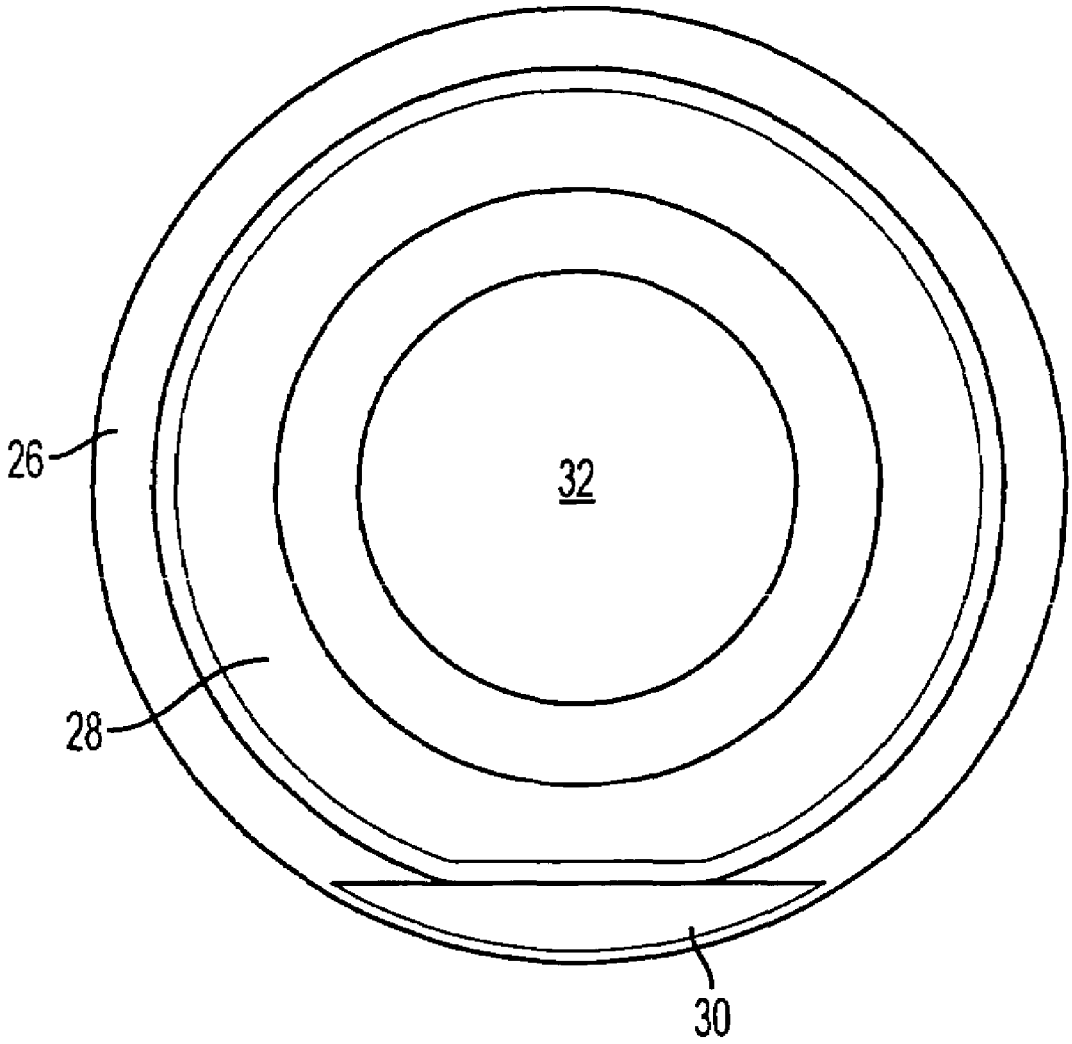
FIG. 7 is a bottom view of the exemplary embodiment shown in FIG. 1.
Figure 9:
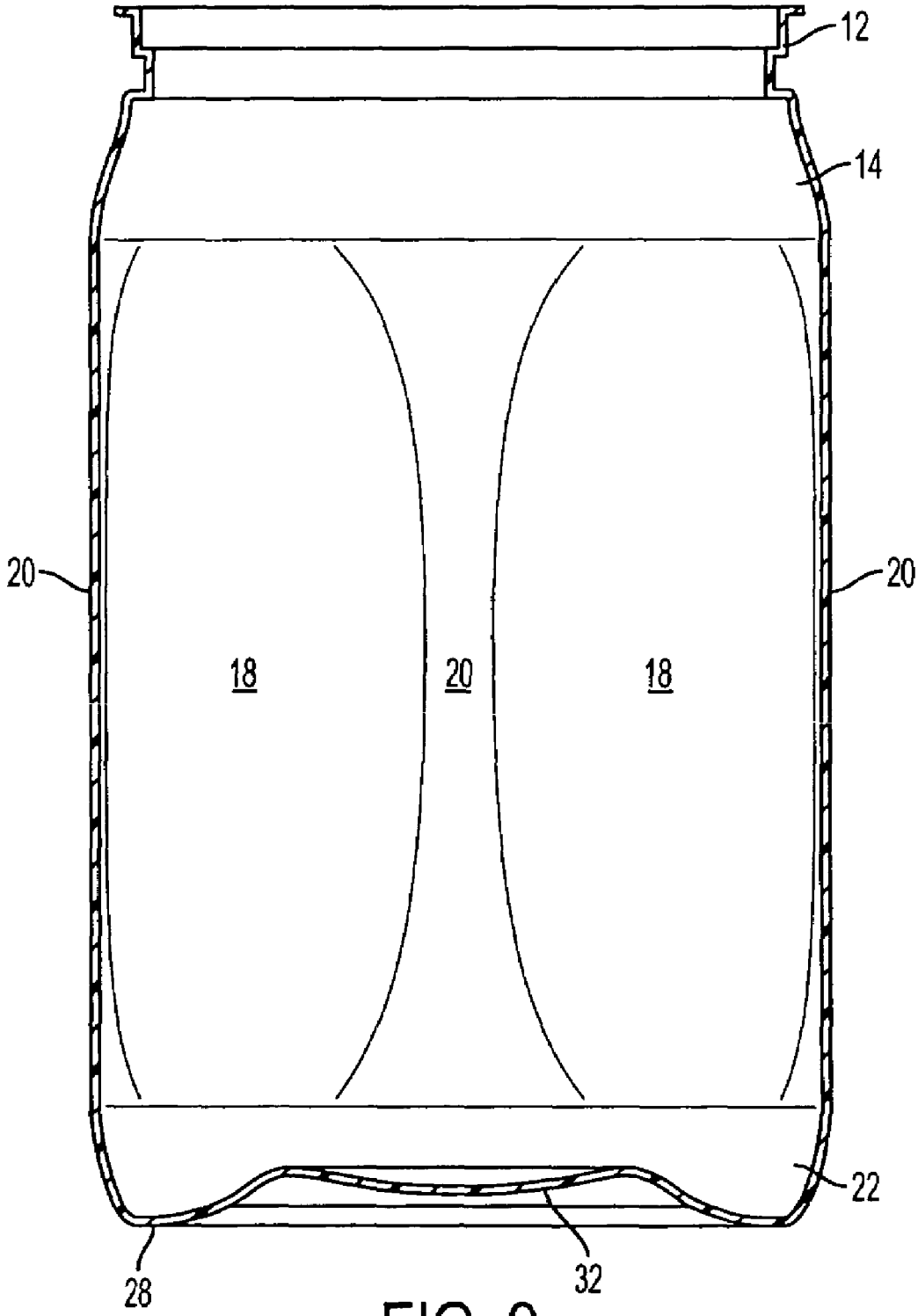
FIG. 9 is a cross-sectional view taken along line 9-9 of the exemplary embodiment shown in FIG. 5.

As illustrated in the cross-section of FIG. 8, the exemplary embodiment of the invention may have four relatively flat panels 18, which extend from upper transition portion 14 to the base portion 22. At least two opposing relatively flat panels 18*a*, 18*b* are slightly concave so that a crosswise length m spanning between a middle of the two opposing relatively flat panels of the generally square-shaped section is smaller than a crosswise length l of the generally square-shaped section adjacent one of the upper transition or base portion. All of the relatively flat panels 18 may have a slightly concave curvature from upper transition portion 14 to base portion 22 as this curvature allows the generally polygonal structure 16 to compensate for overpressure of the retort sterilization process and the resultant vacuum caused by the subsequent cooling. The panels 18 of container 10 preferably should have the same curvature. FIG. 9 show a cross-section of container 10 through a column or corner 20 as shown in FIG. 5. Unlike the relatively flat panels 18, columns or corner 20 are relatively straight to provide the strength to polygonal structure 16. The angle between adjacent relatively flat panels 18 provides the hinge effect so that the relatively flat panels 18 move together while columns 20 remain straight during the overpressure and vacuum associated with sterilization and subsequent cooling. The base portion 22 of container 10 may also have a label lug 30 or indentation that orients the container so that a label is placed with a specific orientation around polygonal structure 16, as shown in FIGS. 3-4 and 7. The base portion 22 of container 10 may not include an indentation and may be symmetrical at its base. As is standard in the art, the bottom surface of base portion 22 may include a push-up 32.

Figure 10:
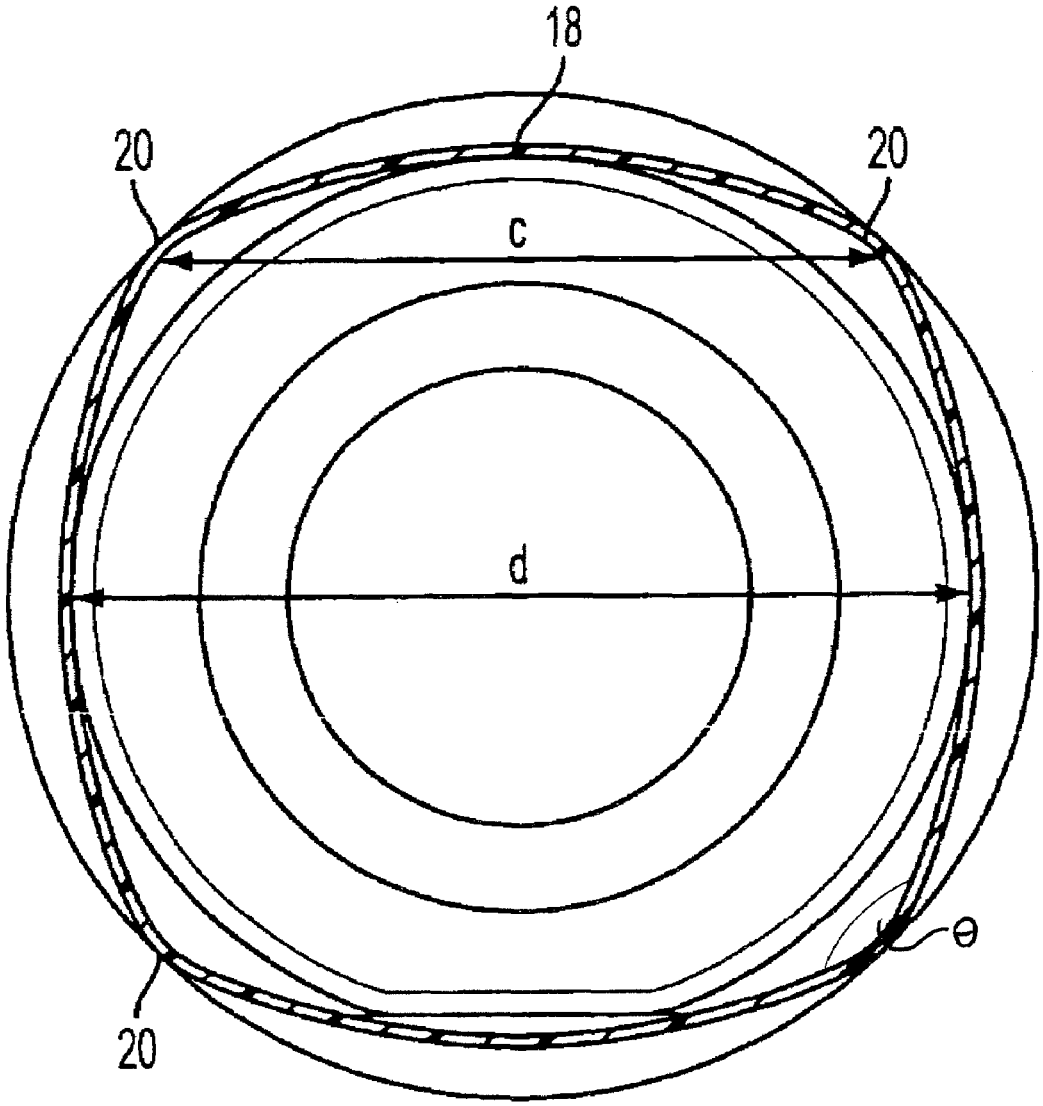
FIG. 10 is a cross-sectional view taken along line 10-10 of the exemplary embodiment shown in FIG. 2.

Relatively flat panels 18 may also curve from side to side as shown in FIG. 10. Opposing relatively flat panels 18 slightly curve outwardly from one column 20 to an adjacent column 20. A crosswise length c of the generally square-shaped section 16 between two adjacent columns 20 is smaller than a crosswise length d of the generally square-shaped section 16 between middles of opposing relatively flat panels 18 with a slight outward curve. The slight convex curvature of relatively flat panels 18 may be pulled inwardly to compensate for the reduced volume of hot-filled product due cooling of the sterilized, hot-filled product. As stated above, the angle formed by adjacent relatively flat panels 18 together with the column 20 is such that all sides of the polygonal structure 16 move together to compensate for overpressure associated with retort sterilization processes and to absorb the resultant vacuum caused by subsequent cooling of the sterilized product.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. While the invention is described with respect to a wide mouth container, the function of the panel curvatures according to the invention should work with a standard finish (i.e., not a wide mouth neck with a finish). It is therefore to be understood that, within the scope of the claims and their equivalents, the invention may be practiced otherwise than as specifically described.

What is claimed is:

1. A plastic container for use in a sterilization process comprising:

a neck having a finish;

an upper transition portion extending from the neck;

a generally polygonal structure having a plurality of relatively flat panels separated by a plurality of columns, wherein at least one of said plurality of columns is rounded;

a base portion where the generally polygonal structure is disposed between the upper transition portion and the base portion wherein adjacent relatively flat panels together with one of the plurality of columns form an angle so that the relatively flat panels of the generally polygonal structure move together during and after the sterilization process thereby maintaining the aesthetics of the plastic container, wherein said relatively flat panels have uniform concave curvature from the upper transition portion to the base portion; and wherein a crosswise length between two of said plurality of columns is less than the crosswise length between two of said panels.

2. The plastic container according to claim 1, wherein the upper transition portion and base portion are approximately rounded sections.

3. The plastic container according to claim 1, wherein the angle formed by adjacent relatively flat panels and the separating column is between about 60° to about 160°.

4. The plastic container according to claim 1, wherein the angle formed by adjacent relatively flat panels and the separating column permits the relatively flat panels of the generally polygonal structure to move together to compensate for overpressure associated with retort sterilization processes and to absorb the resultant vacuum produced by cooling a sterilized, hot-filled product in the plastic container.

5. The plastic container according to claim 1, wherein the generally polygonal structure has four relatively flat panels and adjacent panels are separated by one of the plurality of columns thereby forming a generally square-shaped section.

6. The plastic container according to claim 5, wherein the relatively flat panels extend from the upper transition portion to the base portion and at least two opposing relatively flat panels are slightly concave so that a crosswise length spanning between a middle of the two opposing relatively flat panels of the generally square-shaped section is smaller than a crosswise length of the generally square-shaped section adjacent one of the upper transition or base portion.

7. The plastic container according to claim 6, wherein two opposing relatively flat panels slightly curve outwardly from one column to an adjacent column so that a crosswise length of the generally square-shaped section between two adjacent columns is smaller than a crosswise length of the generally square-shaped section between middles of opposing relatively flat panels with a slight outward curve.

8. A plastic container according to claim 5, wherein the generally polygonal structure is disposed between the upper transition portion and the base portion.

9. A plastic container according to claim 8, further comprising a wide mouth with the finish wherein the upper transition portion extends from the wide mouth to an upper region of the generally polygonal structure.

10. A plastic container for use in a sterilization process comprising:

a number of relatively flat panels forming a generally polygonal structure;

a number of columns separating adjacent relatively flat panels wherein adjacent relatively flat panels together with one of the number of columns form an angle so that the relatively flat panels of the generally polygonal structure move together during and after the sterilization process thereby maintaining the aesthetics of the plastic container, wherein at least one of the number of columns is rounded;

wherein said relatively flat panels have uniform concave curvature from the upper transition portion to the base portion; and wherein a crosswise length between two of said number of columns is less than the crosswise length between two of said panels.

11. The plastic container according to claim 10, further comprising an upper transition portion and a base portion wherein the upper transition portion and the base portion are approximately rounded sections.

12. The plastic container according to claim 10, wherein the angle formed by adjacent relatively flat panels and the separating column is between about 60° to about 160°.

13. The plastic container according to claim 10, wherein the angle formed by adjacent relatively flat panels and the separating column permits the relatively flat panels of the generally polygonal structure to move together to compensate for overpressure associated with retort sterilization processes and to absorb the resultant vacuum produced by the cooling a sterilized, hot-filled product in the plastic container.

14. The plastic container according to claim 10, wherein the generally polygonal structure has four relatively flat panels and adjacent panels are separated by the number of columns thereby forming a generally square-shaped section.

15. The plastic container according to claim 14, further comprising an upper transition portion and a base portion wherein the relatively flat panels extend from the upper transition portion to the base portion and at least two opposing relatively flat panels are slightly concave so that a crosswise length spanning between a middle of the two opposing relatively flat panels of the generally square-shaped section is smaller than a crosswise length of the generally square-shaped section adjacent one of the upper transition or base portion.

16. The plastic container according to claim 15, wherein two opposing relatively flat panels slightly curve outwardly from one column to an adjacent column so that a crosswise length of the generally square-shaped section between two adjacent columns is smaller than a crosswise length of the generally square-shaped section between middles of opposing relatively flat panels with a slight outward curve.

17. A plastic container for use in a sterilization process comprising:

a neck for receiving a hot-filled product;

an upper transition portion extending from the neck;

a generally polygonal structure having a plurality of relatively flat panels separated by a plurality of columns, wherein at least one of said plurality of columns is rounded;

a base portion where the generally polygonal structure is disposed between the upper transition portion and the base portion and a volume of the container is created between the base portion and the upper transition portion wherein adjacent relatively fiat panels together with one of the plurality of columns form an angle so that the relatively flat panels of the generally polygonal structure move together to compensate for pressure differences due to the sterilization process and subsequent cooling of the hot-filled product thereby maintaining the aesthetics of the plastic container;

wherein said relatively flat panels have uniform concave curvature from the upper transition portion to the base portion; and wherein a crosswise length between two of said plurality of columns is less than the crosswise length between two of said panels.

18. The plastic container according to claim 17, wherein the generally polygonal structure has four relatively flat panels and said adjacent panels are separated by the separating columns thereby forming a generally square-shaped section.

19. The plastic container according to claim 18, wherein the relatively flat panels extend from the upper transition portion to the base portion and at least two opposing relatively flat panels are slightly concave so that a crosswise length spanning between a middle of the two opposing relatively fiat panels of the generally square-shaped section is smaller than a crosswise length of the generally square-shaped section adjacent one of the upper transition or base portion.

20. The plastic container according to claim 19, wherein two opposing relatively flat panels slightly curve outwardly from one column to an adjacent column so that a crosswise length of the generally square-shaped section between two adjacent columns is smaller than a crosswise length of the generally square-shaped section between middles of opposing relatively flat panels with a slight outward curve.

* * * * *

UNITED STATES PATENT AND TRADEMARK OFFICE

CERTIFICATE OF CORRECTION

PATENT NO. : 7,571,827 B2
APPLICATION NO. : 11/141322
DATED : August 11, 2009
INVENTOR(S) : Haley et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1081 days.

Signed and Sealed this

Seventh Day of September, 2010

David J. Kappos

David J. Kappos
*Director of the United States Patent and Trademark Office*